US006499345B1

(12) United States Patent
Bucher et al.

(10) Patent No.: US 6,499,345 B1
(45) Date of Patent: Dec. 31, 2002

(54) MEASURING DEVICE FOR THREAD-LIKE TEST SAMPLES

(75) Inventors: Cyrill Bucher, Bassersdorf (CH); Roger Pidoux, Uitikon (CH)

(73) Assignee: Zellweger Luwa AG, Uster (CH)

( * ) Notice: Subject to any disclaimer, the term of this patent is extended or adjusted under 35 U.S.C. 154(b) by 0 days.

(21) Appl. No.: 09/744,915

(22) PCT Filed: Jul. 23, 1999

(86) PCT No.: PCT/CH99/00340

§ 371 (c)(1),
(2), (4) Date: Mar. 22, 2001

(87) PCT Pub. No.: WO00/07921

PCT Pub. Date: Feb. 17, 2000

(30) Foreign Application Priority Data

Jul. 31, 1998 (CH) ..... 1612/98

(51) Int. Cl.[7] ..... G01L 5/04; C25D 5/10; D02J 3/16

(52) U.S. Cl. ..... 73/160; 73/159; 428/908.8; 428/615.4; 28/226

(58) Field of Search ..... 73/160, 159, 828, 73/849, 788; 428/908.8; 242/615.4; 28/226

(56) References Cited

U.S. PATENT DOCUMENTS 3,960,593 A * 6/1976 Heusser ..... 134/37
4,638,169 A * 1/1987 Thomann ..... 250/560
4,706,014 A * 11/1987 Fabbri ..... 324/61 P
5,054,317 A 10/1991 Laubscher
5,493,918 A * 2/1996 Barat et al. ..... 73/862.41
5,530,368 A 6/1996 Hildebrand
5,688,051 A * 11/1997 King et al. ..... 374/129
5,768,938 A 6/1998 Schilling et al.
5,842,373 A * 12/1998 Stein et al. ..... 73/160
5,926,267 A * 7/1999 Farber ..... 356/238

FOREIGN PATENT DOCUMENTS

JP 02073136 3/1990
WO WO93/12028 6/1993

* cited by examiner

*Primary Examiner*—Hezron Williams
*Assistant Examiner*—Katina Wilson
(74) *Attorney, Agent, or Firm*—Burns, Doane, Swecker & Mathis, L.L.P.

(57) ABSTRACT

The invention relates to a measuring device for thread-like test samples (3), comprising a measuring slit (2) exhibiting measuring areas (6, 7) for measuring characteristics of a test sample which moves longitudinally, said measuring areas being associated to a measuring device. A coating (8) made of an abrasion-resistant material is applied over the whole measuring slit and its measuring areas (6, 7) in order to define more freely the dimensions of said measuring slit and especially to obtain a narrower measuring slit.

12 Claims, 2 Drawing Sheets

MEASURING DEVICE FOR THREAD-LIKE TEST SAMPLES

The invention relates to a measuring device having a measuring slit with measuring zones, for measuring the characteristics of a moving thread-type test sample, which are associated with a measuring device.

Such a measuring device is known for yarn, for example from U.S. Pat. No. 3,377,852. In this meaning device, two electrodes are installed in a slit in a plastics block, in such a way that together they form a measuring capacitor, the measuring field of which crosses the slit. The surface of this slit is coated with a thin layer of a material, the electrical conductivity of which is less than that of the electrodes. This is intended to ensure that locally occurring electrostatic charges arising as a result of contact with the moving yarn are distributed over this layer and dissipated.

A disadvantage of such a known measuring device is that defining the conductivity of the thin layer is very difficult, since it is necessary to prevent the layer from effecting an expansion of the surface area of the electrodes. Moreover, it only makes sense to provide this layer if the yarn to be measured is electrostatically charged and frequently touches or might touch the side walls of the slit. In addition, this layer may become worn, which also means that the electrical properties of the slit then change again.

It is further known that optically operating devices are also available for measuring yarn, which likewise form a slit for the yarn. The beam path of an optical system extends over this slit, which optical system opens into the side walls of the slit.

Measuring slits in optically operating yarn measuring devices may be soiled by the yarn to be measured, which impairs optical measurement. This soiling may be counteracted by a degree of self-cleaning by the moving yarn. In order effectively to combat soiling by self-cleaning, the dimensions of the measuring slit must be favourably adjusted. A disadvantage of such an arrangement is that, in the case of narrow measuring slits, undue wear of the side faces or of the elements installed therein has to be expected. However, this restricts freedom of design in relation to such measuring slits and yarn measuring means in general.

The object to be achieved by the invention consists in increasing design options in the case of devices for measuring thread-type test pieces, in particular with regard to the construction of the measuring slit.

This is achieved according to the invention in that at least part of the measuring slit is covered with an abrasion-resistant coating, which is insensitive to wear by the moving yarn. This coating preferably covers electrodes, lenses or windows of optical devices embedded in the side walls of the measuring slit or parts thereof, as well as spaces or joints between the above-mentioned devices or electrodes and the other parts of the measuring slit. The measuring slit is coated by printing, dipping, vapour deposition, sputtering or spraying with a material which preferably enters into chemical combination with the surface of the above-mentioned parts in the slit and remains applied in a layer thickness of for example 20–30 nm.

The advantages achievable thereby are in particular that the service life of the measuring slit may be increased. Another advantage consists in the fact that the measuring field, i.e. the space in which there extends the beam path of an optical system or the electrical field of a capacitive system, may be reduced. This may be achieved on the one hand by a reduced slit width and on the other hand by a smaller surface area of the electrodes or the optical elements which adjoin the measuring slit. A further advantage consists in the fact that the self-cleaning effect of the measuring slit may be better exploited. This may be achieved by a reduced slit width. Soiling or deposits may then be more reliably removed by the test piece itself. This action is the greater, the narrower is the measuring slit and the more probable is contact between the test piece or protruding parts thereof and the side walls. Or, it is possible to dispense with lateral guidance, if the position of the test piece in the slit is of no importance.

A narrower slit also has the advantage that the effect of the shape, i.e. the fact that the cross section of the test piece may not be circular but possibly oval, on measurement of the mass of the test piece is reduced considerably. This is because, in a narrow slit, the yarn no longer appears to the electrodes or the optical elements as a flat body, as in a very wide slit.

The design according to the invention of a measuring slit also creates better conditions for installing an optical and a capacitive measuring system together in a measuring slit.

The invention is explained in more detail below with the aid of an Example and with reference to the attached Figures, in which.

Figure 1:
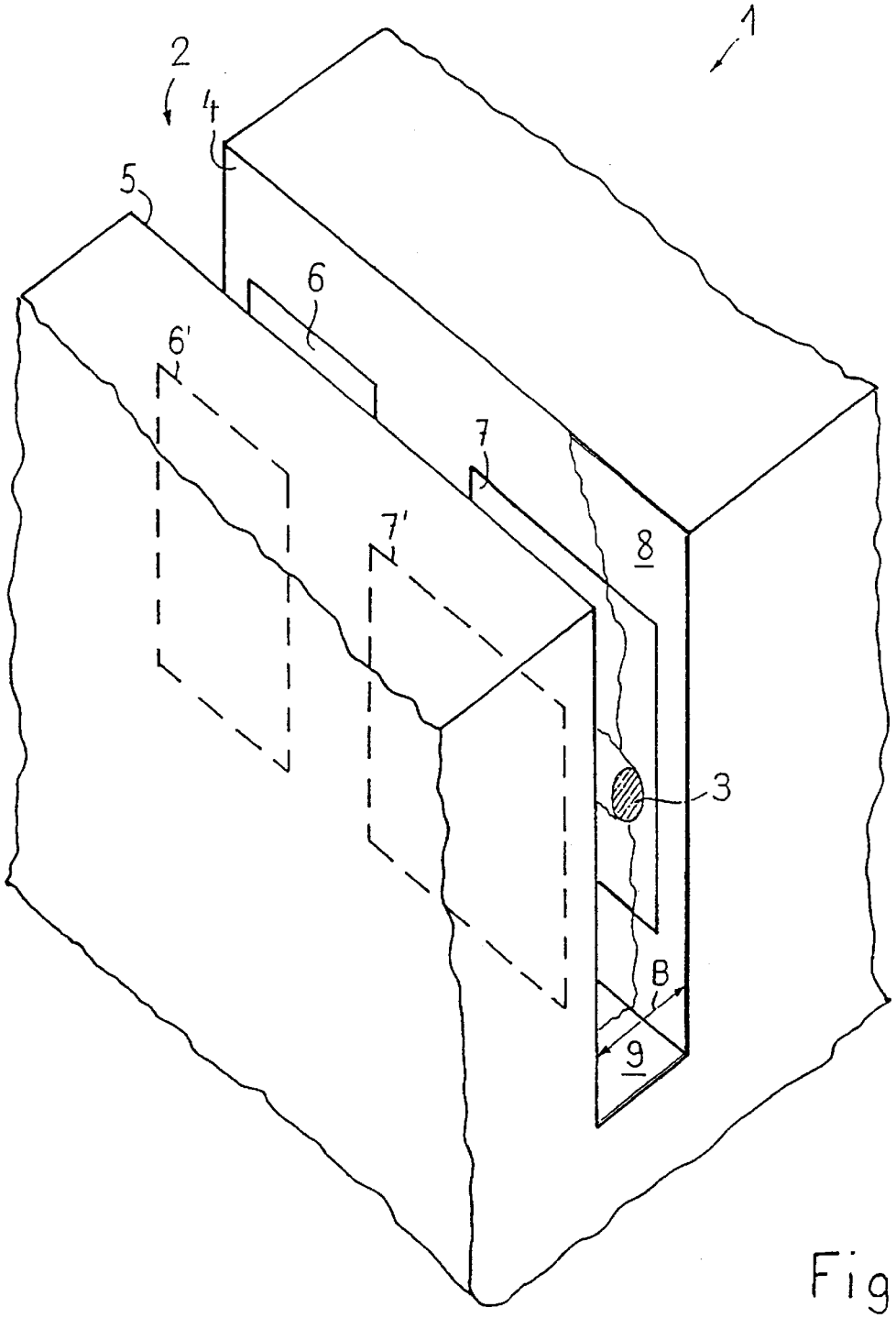
FIG. 1 is a schematic representation of a measuring slit.

The Figures are schematic, simplified representations of a part 1 of a measuring device with a measuring slit or slit 2 for a test piece 3, here for example a yarn. Elements 6 and 7 of measuring devices are attached to side walls 4 and 5 of the slit 2 or embedded in the side walls 4, 5. These elements 6, 7 may comprise electrodes of a capacitively operating measuring system or windows, faces of prisms, lenses or other components of an optically operating measuring system. Corresponding elements 6' and 7' are located in the opposing side wall. The elements 6, 6' or 7, 7' define on the side walls 4, 5 measuring zones of a measuring device, known per se and therefore not described in any more detail here, for measuring yarn characteristics such as mass, diameter, hairiness, colour, foreign fibre content etc. A coating 8 here partly covers the side wall 4 with the elements 6 and 7. This coating may cover only the elements 6, 6', 7, 7' or only the base 9 or the entire side walls 4 and 5 and optionally also the base 9 of the slit 2 and consists of an abrasion-resistant material, which is preferably transparent to optical measuring systems or conductive with regard to capacitive measuring systems. The coating preferably has glass-like characteristics, i.e. it is transparent, hard and smooth, such that it offers little resistance to the test piece if touched.

The coating may be obtained for example by inorganic material synthesis and form a so-called nano-composite, with which for example a glass-like, scratch-resistant but non-fragile or brittle surface may be achieved. The coating may be applied by dipping the part 1 into the coating material or by spraying thereof. The coating may consist of a so-called sol, which enters into chemical combination with the material at the surface of the measuring slit. Such sols are known from sol-gel technology.

The coating makes it possible, for example, to restrict the width 3 of the slit to a value which corresponds to 4 to 10 times the diameter of the test piece 3 or to provide novel slit shapes, as shown in the Figures described below.

Figure 2:
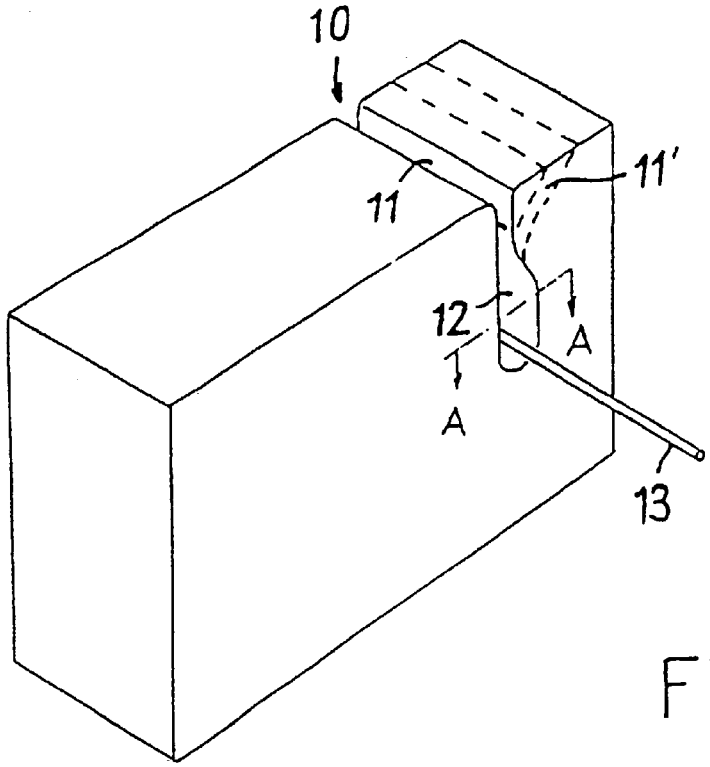
FIG. 2 shows part of a measuring device with a measuring slit.

FIG. 2 shows part of a measuring device with a coated measuring slit 10, which may be subdivided into an inlet part 11 and a measuring part 12. A test piece 13 requiring measurement is located in the measuring part 12. Another arrangement of an inlet part 11' is also revealed, which is not arranged as usual in the same axis as the measuring part 12, but rather issues to the side. Both inlet parts 11 and 11' screen the measuring part 12 against foreign light by means of their narrow cross section, which is advantageous in optical measuring systems. This applies to a greater extent in the case of the inlet part 11'.

Figure 3:
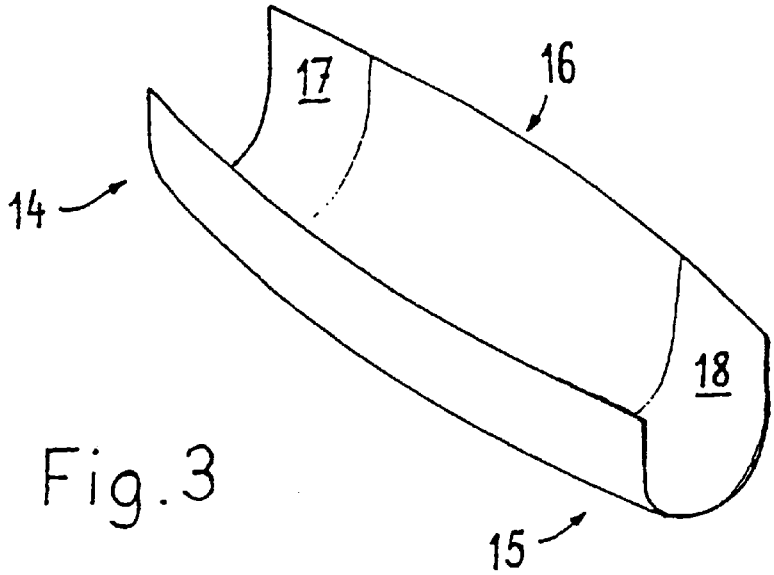
FIG. 3 is a schematic representation of part of a measuring slit.

The coating according to the invention allows the measuring part 12 also to be constructed with three-dimensionally curved side faces 17, which also act as thread guides, as is revealed by FIG. 3.

FIG. 3 shows a view of the measuring part 12 starting from a section plane as indicated by arrows A—A in FIG. 2. This reveals the end areas 14 and 15 together with a central area 16, wherein the central area 16 has a larger cross section than the end areas 14, 15. This means here too that the base, i.e. that part of the slit designated 9 in FIG. 1, no longer runs parallel to the test piece and is not flat. In the embodiment shown, the base is deeper in the middle of the slit than at the ends. It is thus possible, for example, to provide only the end areas 14, 15 with a layer 17, 18 according to the invention, such that the latter may assume the function of a guide for the test material. Thus, many other shapes are also feasible for the measuring part 12. Nevertheless, the area 16 may be provided with a layer for the better protection thereof. If the slit 2 is continuous at its base, i.e. is constructed without discontinuities such as steps, deposits are also removed continuously or entrained by the test material. This is particularly important in the case of test samples which, like yarns, consist of fibres.

What is claimed is:

1. A measuring device for thread-type test samples, comprising a measuring slit (2) with at least one measuring zone (6, 7) for measuring the characteristics of a moving test piece, said measuring slit (2) having spaced apart wall portions providing therebetween a space through which the test piece may be drawn with surfaces of said wall portions facing the path of the test piece, said wall portions having measuring sensor components associated therewith in said at least one measuring zone for establishing a measuring field that extends between said wall portions and intersects the path of the test piece, and a coating (8) covering surfaces of said components and wall portions which face the path of the test piece through the measuring slit, said coating being a coating of an abrasion-resistant material which is insensitive to wear by the moving test piece and does not interfere with said measuring field.

2. A measuring device according to claim 1, wherein said coating consists of material exhibiting glass-like characteristics.

3. A measuring device according to claim 1, wherein said coating is formed by a nano-composite obtained from inorganic material synthesis.

4. A measuring device according to claim 1, wherein said coating exhibits a thickness of 20–30 nm.

5. A measuring device according to claim 1, wherein said measuring slit with the coating exhibits a width (B) which corresponds to 4 to 10 times the diameter of the test piece.

6. A measuring device according to claim 1, wherein said coated measuring slit comprises an inlet part (11) and a measuring part (12).

7. A measuring device according to claim 6, wherein said inlet part comprises a narrower cross section than the measuring part (12).

8. A measuring device according to claim 6, wherein said measuring part comprises three-dimensionally curved side faces (17).

9. A process for producing a measuring device according to claim 1, wherein said coating is applied at least to parts of the measuring slit and enters into chemical combination with the material at the surface of the measuring slit.

10. A measuring device according to clam 1, wherein said components are components of an optical measuring system.

11. A measuring device according to clam 1, wherein said components are components of a capacitive measuring system.

12. In apparatus for measuring characteristics of a thread as the thread is being drawn longitudinally through a measuring gap having walls on opposite sides of the thread path, with one of said walls having associated therewith a light receiver and the other of said walls having associated therewith a light emitter for directing light across said gap to said light receiver along a path that passes through transparent components located at the facing surfaces of said walls and intersects said thread path, the improvement which comprises:

a coating of abrasion resistant material covering said facing surfaces of said walls at the locations of said transparent components, said coating being contacted by the moving thread to remove foreign matter deposits from the light path but being insensitive to wear by the moving thread.

* * * * *